US005163579A

United States Patent [19]

Jones

[11] Patent Number: 5,163,579

[45] Date of Patent: Nov. 17, 1992

[54] TRASH RECEPTACLE WITH RETRACTABLE FOOT PEDAL

[76] Inventor: Gary C. Jones, Apt. No. 12 I, 1175 Haywood Rd., Greenville, S.C. 29615

[21] Appl. No.: 749,997

[22] Filed: Aug. 26, 1991

[51] Int. Cl.[5] ..... A61D 25/28

[52] U.S. Cl. ..... 220/629; 220/630; 220/636; 220/908

[58] Field of Search ..... 220/908, 629, 630, 636, 220/17.1, 17.2

[56] References Cited

U.S. PATENT DOCUMENTS

| | | | |
|---|---|---|---|
| 870,613 | 11/1907 | Blue | 220/17.2 |
| 1,521,782 | 1/1925 | Meier | 220/17.2 |
| 1,924,824 | 8/1933 | Yeager | 220/629 |
| 3,575,284 | 4/1971 | Holt | 220/629 |
| 4,363,417 | 12/1982 | Rhoades et al. | 220/908 |
| 4,505,408 | 3/1985 | Sagol | 220/629 |
| 4,558,796 | 12/1985 | Jaicks | 220/908 |
| 4,635,811 | 1/1987 | Lodi | 220/629 |
| 4,666,054 | 5/1987 | Jaicks | 220/908 |

*Primary Examiner*—Joseph Man-Fu Moy
*Attorney, Agent, or Firm*—George A. Bode; D. Neil LaHaye

[57] ABSTRACT

A trash receptacle having a main body portion including side walls and an open top and closed bottom, one of the side walls being provided with a recessed area adjacent its bottom. A pedal pivotally mounted on one end at the bottom of the recessed area is retained in a first or normally retracted position adjacent the main body portion by a spring in contact with the pedal. Pressure on the pedal moves it to a second or lowered substantially horizontal position for holding the trash receptacle down by foot pressure while removing a bag liner.

5 Claims, 1 Drawing Sheet

TRASH RECEPTACLE WITH RETRACTABLE FOOT PEDAL

BACKGROUND OF THE INVENTION

1. Field of the Invention

The present invention is generally related to trash receptacles, and more particularly, to a trash receptacle having a foot pedal for holding down the receptacle during unloading.

2. General Background

Trash receptacles used in homes and businesses are typically lined with a disposable paper or plastic bag to receive the trash. This serves the dual purpose of eliminating the need to clean the receptacle and providing a disposable container for the trash. However, when the bag becomes full, removal from the receptacle can be difficult. The weight of the trash presses the bag against the side of the receptacle and causes lifting of the receptacle along with the bag. Since lifting of the bag is usually a two-handed procedure, a means for holding down the trash receptacle that does not require the use of a person's hands while lifting the bag is needed. Trash receptacles known to the inventor include the following.

U.S. Pat. No. 1,286,368 entitled "Odorless Garbage Receptacle" discloses a garbage receptacle having two fixed position, oppositely directed foot pieces that extend outwardly from the bottom of the receptacle for standing on when removing an upper hopper from the receptacle.

U.S. Pat. No. 1,351,747 entitled "Garbage Can" discloses a trash receptacle designed to receive an inner container having a conical bottom. The inner container rests on a ring and tabs positioned inside the main container, and, is provided with handles for lifting it out of the main container.

U.S. Pat. No. 4,440,321 entitled "Debris Receptacle, Cover, And Contents Compressor And Discharge Assembly" discloses a receptacle and cover assembly for collecting lawn debris and the like. A bottom skirt portion provides access to a movable bottom panel member that serves as a discharge assist piston.

U.S. Pat. No. 4,763,809 entitled "Waste Container And Adjustable Bag Linear Packaged Holder Combination" discloses a rigid container with a rigid bottom skirt. An adjustable pawl arm extends through the skirt and is provided with a vertical member to hold a supply package of linear bags between the vertical member and the container.

U.S. Pat. No. 4,930,653 entitled "Refuse Container Caddy Apparatus" discloses a caddy apparatus for refuse containers for securely holding polygonal or circular cross-section containers.

U.S. Pat. No. 3,306,486 entitled "Waste Receptacle" discloses a waste receptacle useful in commercial areas that may be anchored to a horizontal surface and is provided with a hood and pivoting door.

U.S. Pat. No. 3,927,786 entitled "Containers For Waste For Use With Trash Bags" discloses a waste container where a tubular member opened at both ends is attached at one end to a tub. Lifting of the tubular member away from the tub and trash bag eliminates the need to lift the heavy trash bag the full height over the container when unloading.

U.S. Pat. Nos. RE 30,875; 4,972,966; and, 4,785,964 disclose molded receptacles that provide for the use of foot pedals to lift the top.

Although a variety of trash containers are known, none are specifically directed to a trash receptacle that provides a hands-free means for holding down the receptacle while removing the bag liner and that also does not require extra space beyond the receptacle when this feature is not in use.

SUMMARY OF THE PRESENT INVENTION

The preferred embodiment of the apparatus of the present invention solves the aforementioned problems in a straightforward and simple manner. What is provided is a trash receptacle with a retractable foot pedal. The trash receptacle is a container formed from a main body portion having an open upper end and a closed bottom. The main body portion is provided with a recessed area adjacent the bottom. A pedal pivotally mounted at the bottom of the recessed area is movable between a first normally retracted position abutting the wall of the recessed area and a second lowered, substantially horizontal position. In its first position, the pedal takes minimal space outside of the main body portion. In its second lowered position, the pedal provides a temporary anchoring point for the receptacle by the placement of a person's foot thereon. This allows a bag liner to be removed from the receptacle with both hands without lifting the trash receptacle.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
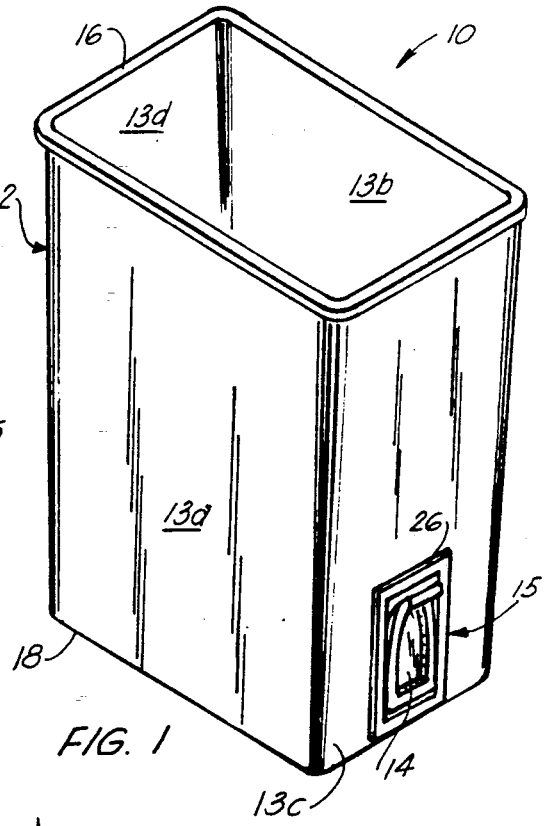
FIG. 1 is a top perspective elevational view of the preferred embodiment of the apparatus of the present invention.

Referring now to the drawings, and in particular FIG. 1, the apparatus of the present invention is designated generally by the numeral 10. Apparatus 10 is generally comprised of main body portion 12 and pedal assembly 15.

Main body portion 12 has front and rear walls 13*a*, 13*b* and side walls 13*c*, 13*d* an open upper end 16 and closed bottom 18. In the preferred embodiment illustrated in FIGS. 1–4, main body portion 12 is illustrated as being rectangular in cross-section. However, it should be understood that any shape including circular may be used.

Figure 3:
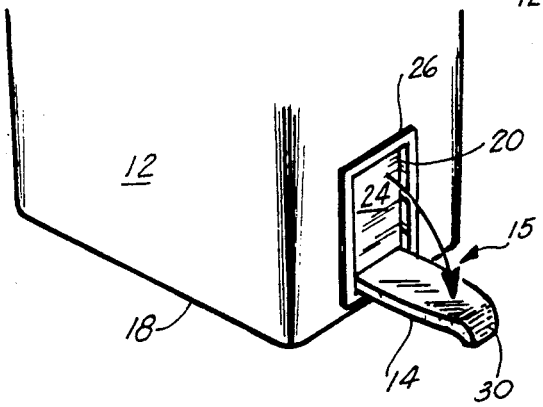
FIG. 3 is a partial perspective view illustrating the pedal of the invention in its second or lowered position.
Figure 2:
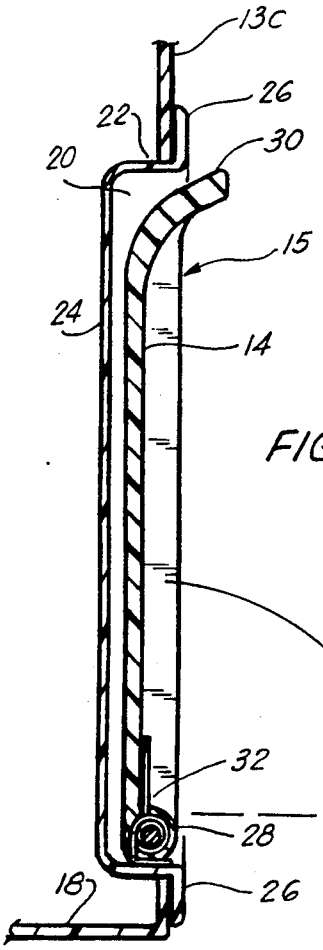
FIG. 2 is a partial side sectional view illustrating the pedal of the invention in its first or retracted position.

Main body portion 12 is provided with recessed area 20 in side wall 13*c* adjacent bottom 18 which accommodates pedal assembly 15. As best seen in FIG. 2, recessed area 20 is formed by providing rectangular cutout or notch 22 in side wall 13*c* of main body portion 12. Plate 24 is U-shaped in cross-section, as best seen in FIG. 3, and sized to fit within U-shaped cutout 22. Plate 24 is provided with circumferential flange 26 that extends at right angles thereto. This allows plate 24 to be received in cutout 22 while flange 26 acts as a stop against side wall 13*c* of main body portion 12. Flange 26 is permanently attached to main body portion 12 by any suitable means such as gluing or sizing the plate 24 and flange 26 to rigidly snap into place in recessed area 20.

Figure 4:
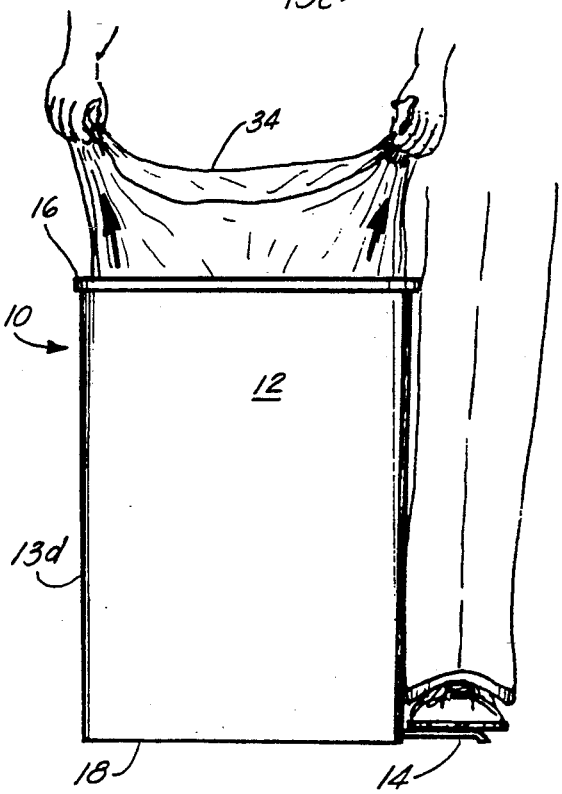
FIG. 4 is a side view illustrating the invention in use.

Pedal assembly 15 includes pedal 14 which is pivotally mounted to the lower end of plate 24, that is the end near the bottom of recessed area 20, on hinge pin 28. Each end of hinge pin 28 is secured in opposing sides of plate 24 as best seen in FIGS. 2 and 3. The opposite or free end of pedal 14 is provided an arcuate tab 30 that extends or arcs outwardly away from main body portion 12 when pedal 14 is in the retracted position of FIGS. 1 and 2. Tab 30 serves as a pressure point for moving pedal 14 from its first or normally retracted position adjacent plate 24 (FIGS. 1 and 2) to its second or lowered position (FIGS. 3 and 4). Pedal 14 is retained in its first or normally retracted, substantially vertical position by the urging of spring 32. In a manner known, spring 32 is mounted on hinge pin 28 and bears against plate 24 and pedal 14 (as best seen in FIG. 2) to maintain pedal 14 in its first or normally retracted position while also allowing it to be moved to its second or lowered position (FIGS. 3 and 4). Spring 32 causes pedal 14 to move back to its first or normally retracted position with release of pressure thereon.

In operation, a person puts pressure on tab 30 with his foot and causes pedal 14 to move from its first or normally retracted, substantially vertical position of FIGS. 1 and 2, to its second or lowered, substantially horizontal position of FIGS. 3 and 4. Liner bag 34 may then be easily removed from trash receptacle 10 without lifting the receptacle also as best illustrated in FIG. 4.

Upon release of foot pressure on pedal 14, it is caused to return to its first or normally retracted position of FIGS. 1 and 2 by the urging of spring 32. Trash receptacle 10 may be formed from any suitable material such as molded plastic. In accordance with molding procedures, recessed area 20 may also be integral with main body portion 12 as opposed to using plate 24. As seen in FIG. 2, the use of recessed area 20 requires little or no space exterior of trash receptacle 10 and also minimizes any effect on the interior space available in trash receptacle 10.

Yet a further embodiment of the present invention provides a conventional receptacle 10, without recessed area 20, but with a pedal assembly 15 mounted on the surface of one of the side walls 13*c*, 13*d*. This can be accomplished by the inside surface of plate 24 being fastened to either of side walls 13*c*, 13*d* by fastening means such as gluing, double-sided tape, VELCRO$^R$, ultrasonic welding, or the like.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A trash receptacle, comprising:

(a) a main body portion having side walls and an open upper end and a closed bottom;

(b) said main body portion having a recessed area provided in one of said side walls adjacent said bottom, said recessed area being formed by a U-shaped plate received in a cutout area in said side wall of said main body portion; and, (c) a pedal pivotally mounted in said recessed area so as to be movable between a first normally retracted, substantially vertical position and a second lowered, substantially horizontal position.

2. The apparatus of claim 1, wherein said pedal is provided with a tab at its distal end that extends outwardly away from said main body portion when said pedal is in its first normally retracted position.

3. The apparatus of claim 1, further comprising means for urging said pedal to its first normally retracted position.

4. A trash receptacle, comprising:

(a) a main body portion having side walls and an open upper end and a closed bottom;

(b) said main body portion having a recessed area provided in one of said side walls adjacent said bottom, said recessed area being formed by a U-shaped plate received in a cutout area in said main body portion;

(c) a pedal pivotally mounted in said recessed area so as to be movable between a first normally retracted, substantially vertical position and a second lowered, substantially horizontal position, said pedal having a tab that extends outwardly away from said main body portion when said pedal is in its first normally retracted position; and, (d) means for urging said pedal to its first normally retracted position.

5. The apparatus of claim 4 wherein said urging means is a spring positioned between said pedal and said recessed area.

* * * * *